US006964414B2

(12) United States Patent
Willis

(10) Patent No.: US 6,964,414 B2
(45) Date of Patent: Nov. 15, 2005

(54) JAM CLEARANCE IN A VERTICAL SHEET TRANSPORT IN A PRINTING APPARATUS

(75) Inventor: Keith L. Willis, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 149 days.

(21) Appl. No.: 10/669,903

(22) Filed: Sep. 24, 2003

(65) Prior Publication Data

US 2005/0062222 A1 Mar. 24, 2005

(51) Int. Cl.[7] ..... B65H 5/00
(52) U.S. Cl. ..... 271/272; 271/264; 271/273
(58) Field of Search ..... 271/9.13, 264, 271/273, 274, 256

(56) References Cited

U.S. PATENT DOCUMENTS 3,821,519 A * 6/1974 Pietenpol ..... 360/2
4,431,179 A * 2/1984 Westover et al. ..... 271/274
4,448,407 A * 5/1984 Bashford et al. ..... 271/228
4,815,726 A * 3/1989 Pagowski et al. ..... 271/274
5,265,869 A * 11/1993 Morita ..... 271/274
5,443,255 A * 8/1995 Nanba et al. ..... 271/273
6,236,824 B1 * 5/2001 Pardubitzki ..... 399/124
6,585,261 B2 * 7/2003 Miller et al. ..... 271/264

FOREIGN PATENT DOCUMENTS

JP 4-7227 * 1/1992
JP 4-20443 * 1/1992
JP 4-39238 * 2/1992

* cited by examiner

*Primary Examiner*—Donald P. Walsh
*Assistant Examiner*—Thomas A. Morrison
(74) *Attorney, Agent, or Firm*—R. Hutter

(57) ABSTRACT

In a printing apparatus or copier, a vertical portion of a paper path is formed between two flat members. To remove jammed paper from the path, one of the flat members is moved, by a hinge, from the other, releasing any sheet in the path. Released sheets drop down the path and land on a bottom structure. The bottom structure causes a sheet landing thereon to incline away from the hinge, so that a user can remove the sheet without having to reach far into the path.

10 Claims, 4 Drawing Sheets

JAM CLEARANCE IN A VERTICAL SHEET TRANSPORT IN A PRINTING APPARATUS

TECHNICAL FIELD

The present disclosure relates to printing equipment, such as digital printers and copiers. More particularly, the disclosure relates to the removal of jammed sheets from such apparatus.

BACKGROUND

In mid- to high-volume printing apparatus, such as copiers and "laser printers," the path of a sheet drawn from a supply stack, printed, and passed through a finisher, can be several feet long and fairly complicated. Also, the path necessarily will come close to dangerous structures, such as hot fusing modules, or xerographic engines which may at any time retain large charges. In the case of a paper jam along the path, an untrained user of the apparatus will have to open a cover of the apparatus and reach near or into the path. There are likely to be sharp surfaces inside the machine, as well as threats of burn or shock. It is, therefore, desirable to provide a path architecture in a printer, which minimizes risks to a user's hand when the user has to remove paper or debris from a path inside the printer.

SUMMARY

There is provided an apparatus for conveying sheets. A transport comprises a first flat member and a second flat member disposed substantially parallel to the first flat member. A gap between the first flat member and second flat member forms a path suitable for movement of sheets therethrough. The path is disposed substantially vertically. The second flat member is movable relative to the first flat member to release a sheet disposed in the path. A bottom structure is disposed at a bottom of the transport for causing an edge of a sheet landing thereon to be inclined.

DETAILED DESCRIPTION

Figure 1:
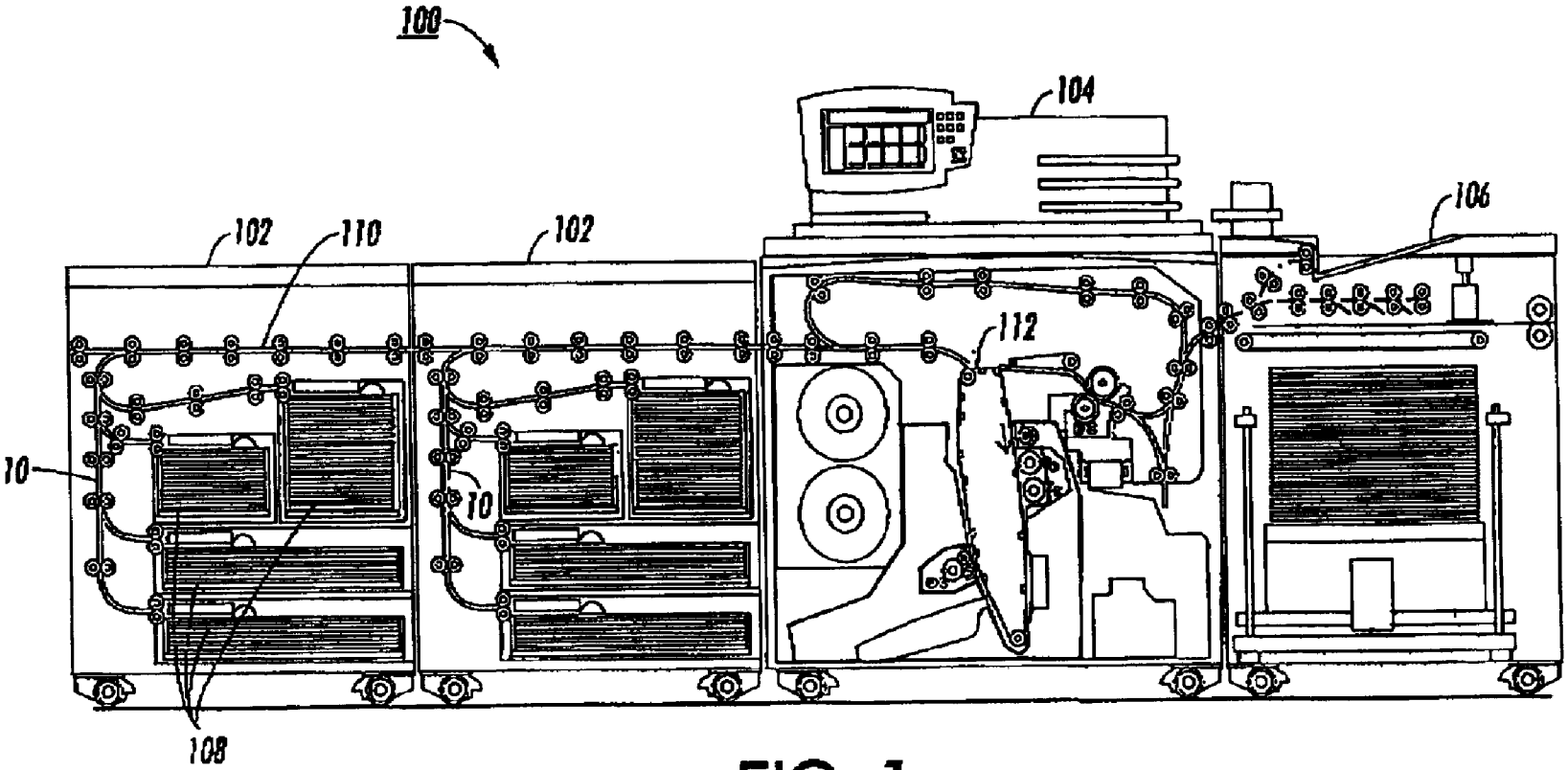
FIG. 1 is an elevational view of a high-volume printing apparatus.

FIG. 1 is an elevational view of a modular high-volume xerographic printing apparatus, which can act as part of a copier. The apparatus 100 in this case includes two substantially identical "feeder modules," each indicated as 102, a marking module 104, and a finisher module 106. In a modular architecture, a number of feeder modules 102 can be placed in series to send blank sheets to the marking module 104 and then to finishing module 106, such as for stacking, stapling, binding, etc. Indeed there may be a number of marking modules 104, such as one for color printing and one for monochrome, and a number of finishing modules 106 for different purposes.

Each feeder module 102 includes a number of supply stacks 108, each of which may have a different predetermined type of substrate for printing on. As needed by the control system of the apparatus, single sheets are drawn from a selected stack 108 and conveyed onto a horizontal path 110 toward, in this case, the photoreceptor 112 in marking module 104. As can be seen, the horizontal path 110 of each module 102 is designed to enable a series arrangement of a number of feeder modules 102 as needed.

In the particular design of a feeder module 102 as shown, for a portion of the path of a sheet from a stack 108 to the horizontal path 110, there is provided what is here called a "vertical transport," indicated as 10, so called because the sheet must move substantially vertically and upward to reach horizontal path 110. A detailed elevational view of a single vertical transport 10 is shown in FIG. 2.

Figure 2:
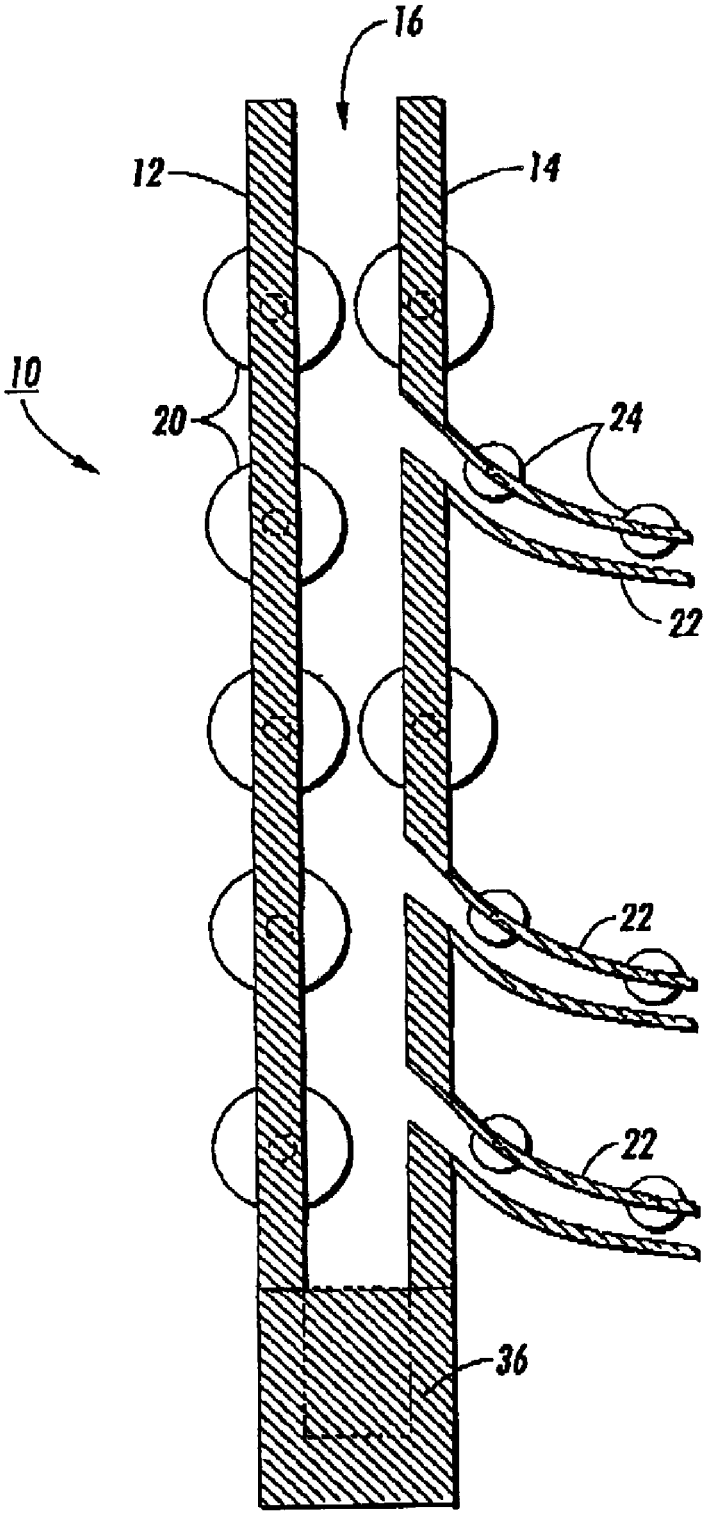
FIG. 2 is a detailed elevational view of a vertical sheet transport, as used in the apparatus of FIG. 1.

In FIG. 2, it can be seen that vertical transport 10 comprises what is here called a first flat member 12 and a second flat member 14. Each flat member defines a surface. A surface of second flat member 14 is disposed parallel to, but spaced from, a surface of first flat member 12, the gap between the flat members forming a path 16 for the passage of sheets therethrough. The surfaces of the flat members 12, 14 adjacent the path 16 may or may not substantially enclose the path 16, depending on a particular design.

Each flat member 12, 14 includes mounted thereon any number of rollers 20. The rollers 20 are mounted on the flat members so that a portion of each roller can extend into the path 16, so as to engage a sheet passing through path 16. In a typical design, the rollers 20 are mounted to extend through small openings in each flat member 12, 14. In some designs, certain of the rollers 20 may be associated with one or more motors (not shown) to drive sheets through the path 16.

Associated with the path 16 are one or more "on-ramps" 22, which are in this case mounted on flat member 14. Each on-ramp 22 includes a pair of baffles which are spaced from one another to form a short path by which a sheet drawn from a stack (such as 108 in FIG. 1) is inserted into the path 16. Each on-ramp 22 may include any number of rollers 24 for proper operation.

In a practical application of such a vertical transport 10, occasionally a sheet being conveyed through the path 16 may become jammed in the path 16. In such an event, a human user of the machine may have to reach into the apparatus to pull out the jammed sheet, which may have been ripped into pieces, from the path 16. In a basic case, the width of path 16 between flat member 12, 14 is typically less than one-half inch and a human user is unlikely to be able to get his fingers into the path 16.

Figure 3:
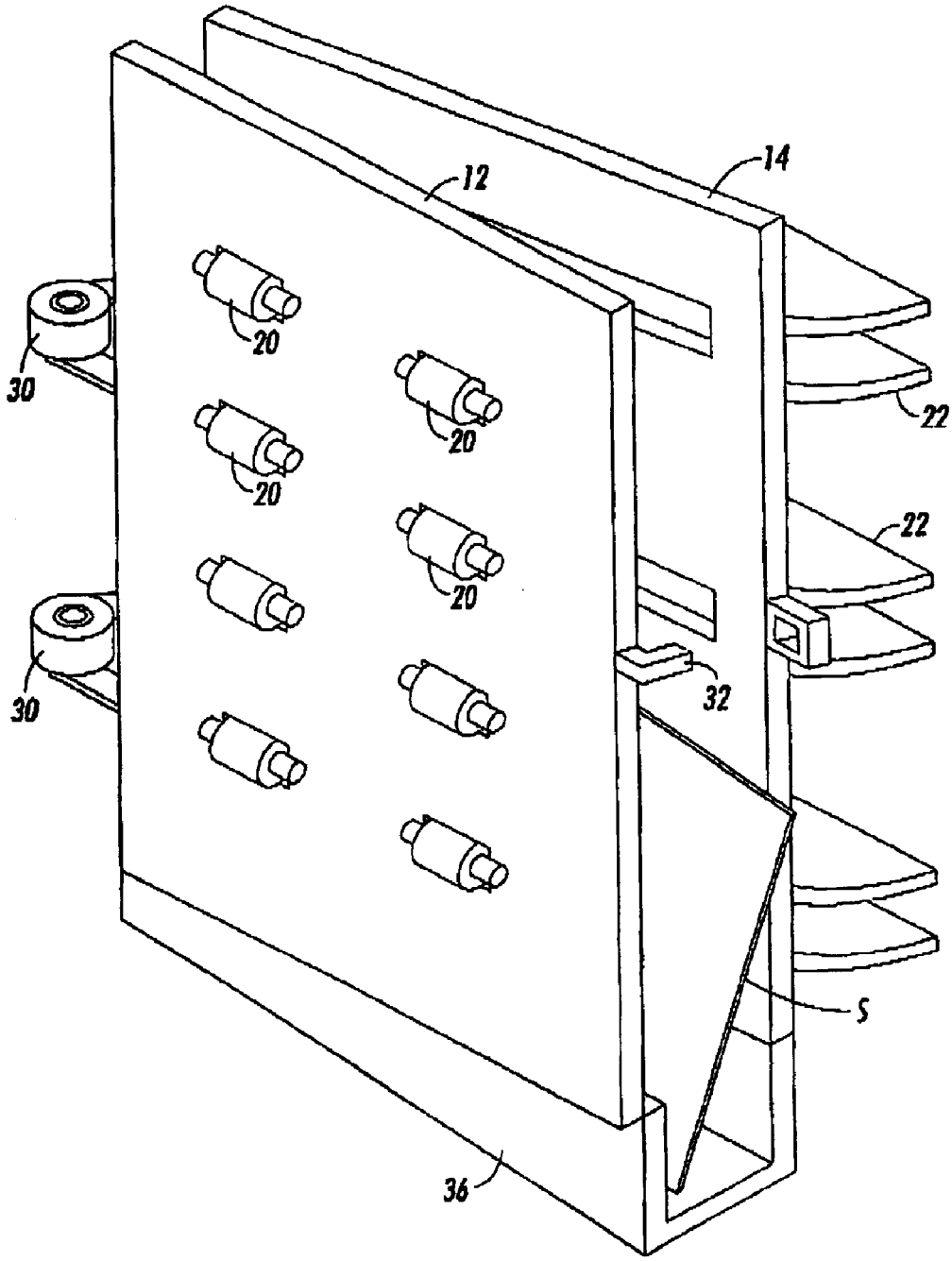
FIG. 3 is a perspective view of the vertical sheet transport of FIG. 2.

In order to make the path 16 accessible for jam clearance, one approach is to make at least one of the flat members 12, 14 movable so that the path 16 can be "opened up." An illustration of how the path 16 can be opened up is shown in the perspective view of FIG. 3. In FIG. 3, it can be seen that the first flat member 12 is mounted on one or more hinges 30 so that, as needed for jam clearance, a latch 32 can be unlatched and one side edge of first flat member 12 can be moved an inch or more away from second flat member 14: in this way any sheet that happens to be in path 16 (which is between flat member 12 and 14) is in effect released from, for example, pressure exerted by various rollers 20. Thus, when the first flat member 12 is moved away from second flat member 14, not only is the path 16 made more accessible, but any sheets therein are likely to fall downward.

According to another aspect of the disclosure, there is provided at the bottom of the transport 10 a "bottom structure," such as an inclined ramp indicated as 36. The main surface of ramp 36 is inclined at a predetermined angle relative to the horizontal, with its lower end toward the latch 32. The function of the incline is to allow a top edge of a sheet S, as shown, which lands on the ramp to tip or slide toward a human user, away from the hinge 30, for easy grabbing by a human user. By tipping or sliding toward the user, the sheet is more easily removed from path 16 by a user's hand than if the sheet had simply dropped straight down from a position within path 16. In this way, a user does not have to reach far into the path 16 to remove sheet S, and therefore risks of injury are lessened.

Figure 4:
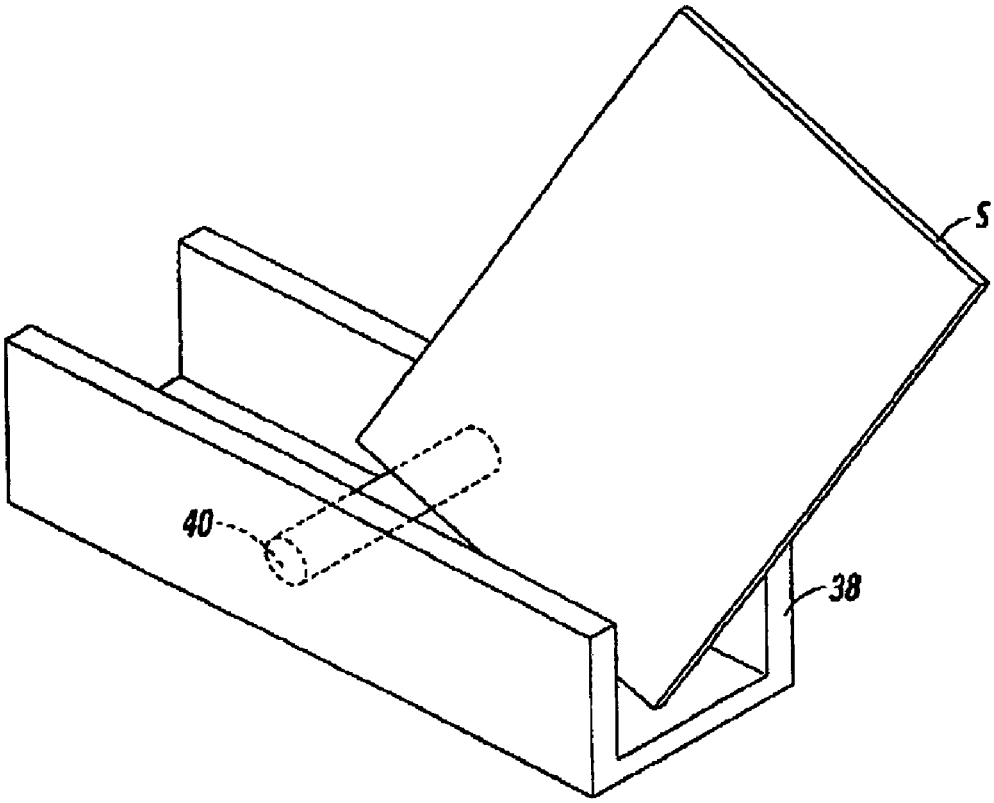
FIG. 4 is a perspective view showing, in isolation, another embodiment of a bottom structure of a vertical sheet transport.

FIG. 4 shows, in isolation, an alternate embodiment of a structure disposed at the bottom of a vertical transport. Instead of an inclined ramp as shown in FIG. 3, this embodiment includes a rod 40, or more broadly a "tipping member," disposed in a suitable position so that a sheet S falling thereon will contact the tipping member and thereby tip or incline its top edge toward a user, as shown. Clearly, any number of possible configurations of a tipping member, besides rod 40, will exhibit this desired effect. More broadly, a "bottom structure" at the bottom of transport 10, whether a tipping member such as rod 40 or inclined ramp 36, should have the effect of causing an edge of a sheet landing thereon to be inclined.

Although FIG. 1 shows the transport in the context of a high-volume xerographic printer, the transport can be used in conjunction with any type of paper-handling equipment, such as mail handling equipment, or a packaging machine.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An apparatus for conveying sheets, comprising:

a transport, the transport comprising a first flat member and a second flat member disposed substantially parallel to the first flat member, a gap between the first flat member and second flat member forming a path suitable for movement of sheets therethrough, the path being disposed substantially vertically;

the second flat member and the first flat member being movable relative to each other to release a sheet disposed in the path;

a hinge attached to at least one of the first flat member and the second flat member, to effect moving of the first flat member relative to the second flat member; and a bottom structure, disposed at a bottom of the transport, for causing an edge of a sheet landing thereon to be inclined, wherein a sheet released from the path drops to the bottom structure and contacts the bottom structure so that an edge of the sheet is inclined away from the hinge.

2. The apparatus of claim 1, the bottom structure including an inclined ramp.

3. The apparatus of claim 1, the bottom structure including a tipping member.

4. The apparatus of claim 3, the tipping member including a rod.

5. The apparatus of claim 1, further comprising at least one set of rollers mounted on at least on, of the first flat member and the second flat member, the rollers operatively disposed in the path and engaging a sheet moving through the path.

6. The apparatus of claim 1, further comprising at least one on-ramp for inserting a sheet into the path.

7. The apparatus of claim 1, further comprising a marking engine, for receiving a sheet in the path and placing an image thereon.

8. The apparatus of claim 7, wherein the marking engine includes a xerographic photoreceptor.

9. The apparatus of claim 1, wherein the transport is configured to facilitate a sheet moving substantially vertically therethrough.

10. The apparatus of claim 9, wherein the transport is configured to facilitate a sheet moving substantially upwardly therethrough.

* * * * *